United States Patent [19]

Noguchi

[11] Patent Number: 4,974,670

[45] Date of Patent: Dec. 4, 1990

[54] LAMINATED EVAPORATOR

[75] Inventor: Ichiro Noguchi, Konan, Japan

[73] Assignee: Diesel Kiki Co., Ltd., Tokyo, Japan

[21] Appl. No.: 485,088

[22] Filed: Feb. 26, 1990

[30] Foreign Application Priority Data

Mar. 31, 1989 [JP] Japan ..... 1-80860

[51] Int. Cl.[5] ..... F28D 1/03

[52] U.S. Cl. ..... 165/153; 165/152; 165/176

[58] Field of Search ..... 165/152, 153, 170, 176

[56] References Cited

U.S. PATENT DOCUMENTS

| | | | |
|---|---|---|---|
| 1,950,500 | 3/1934 | Loprich et al. | 165/153 |
| 4,134,195 | 1/1979 | Jacobsen et al. | 29/157.3 R |
| 4,800,954 | 1/1989 | Noguchi et al. | 165/153 |

FOREIGN PATENT DOCUMENTS

| | | | |
|---|---|---|---|
| 859510 | 12/1940 | France | 165/153 |
| 1448155 | 6/1966 | France | 165/153 |
| 711967 | 9/1931 | Japan | 165/152 |

*Primary Examiner*—Martin P. Schwadron
*Assistant Examiner*—Allen J. Flanigan
*Attorney, Agent, or Firm*—Wenderoth, Lind & Ponack

[57] ABSTRACT

A laminated evaporator includes a plurality of heat exchanging elements and a plurality of corrugated fins disposed alternately and built up into layers. Each of the heat exchanging elements includes at least at its one end a pair of tubular portions and a plurality of spacers. The tubular portions of one heat exchanging element are fitted with the tubular portions of an adjacent heat exchanging element, and spacers of two adjacent heat exchanging elements are joined together to maintain a constant spacing between the adjacent heat exchanging elements.

2 Claims, 3 Drawing Sheets

LAMINATED EVAPORATOR

BACKGROUND OF THE INVENTION

1. Field of the Invention

The present invention relates to a laminated evaporator for use mainly in automobile air-conditioners.

2. Description of the Prior Art

A laminated evaporator of the type concerned is known as disclosed, for example, in Japanese Utility Model Laid-open Publication No. 57-19787. The disclosed laminated evaporator includes a pair of formed plates jointly constituting one heat exchanging element having a bulged tank at its one end or either end. The tank of the heat exchanging element has a flat portion and a pair of holes formed in the flat portion. A plurality of such heat exchanging elements are laminated one another with fins disposed between the adjacent heat exchanging elements. In this instance, the flat portion of one heat exchanging element is held in abutment with the flat portion of an adjacent heat exchanging element so that the tanks of each adjacent pair of the heat exchanging elements are connected together via the holes, thereby defining a channel in the thus laminated heat exchanging elements for the passage of a refrigerant.

With this construction, the flat portions of the respective tanks project perpendicularly to the direction of flow of the refrigerant in the vicinity of the holes and hence increase a flow resistance to the refrigerant. Consequently, a certain part of the refrigerant flowing from one to the adjacent heat exchanging element stagnates in the tank on the upstream side. Owing to this stagnant part, the refrigerant is distributed unevenly over the parallel connected heat exchanging elements and hence lowers the heat exchanging efficiency of the laminated evaporator.

With this drawback in view, there has been proposed a modified laminated evaporator as disclosed in Japanese Patent Laid-open Publication No. 61-211694. Unlike the above-mentioned evaporator, the modified evaporator includes a pair of flanges extending from each heat exchanging element along the direction of flow of a refrigerant and held in engagement with the flanges of an adjacent heat exchanging element. One of the flanges has a retainer portion fitted over the mating flange so as to maintain a predetermined spacing between two adjacent heat exchanging elements.

The conventional joint structure employing the flanges is not satisfactory because dimensional control is difficult to achieve when the flanges and the retainer portion are formed by press working.

In order to maintain the predetermined spacing between the adjacent heat exchanging elements, it is necessary to accurately finish an end of one flange which is adapted to be fitted in the retainer portion of the mating flange. Such precise finishing must be achieved after the stamping of the flange and hence increases the manufacturing cost. Further, the formation of the retainer portion is uneasy to achieve per se.

In assembling the conventional laminated evaporator, one flange is fitted into the retainer portion in the other flange. In this instance, the retainer portion is likely to be crushed by the one flange and hence a fin disposed between two adjacent heat exchanging elements including the crushed retainer portion is deformed or damaged too. With this crushed retainer, the adjacent heat exchanging elements are spaced irregularly and accordingly the heat exchanging efficiency of the evaporator is lowered correspondingly.

SUMMARY OF THE INVENTION

With the foregoing difficulties in view, it is an object of the present invention to provide a laminated evaporator having tanks which provide a small flow resistance and hence increase the overall heat exchanging efficiency of the evaporator.

Another object of the present invention is to provide a laminated evaporator which is simple in construction and is capable of reliably maintaining a constant spacing between adjacent heat exchanging elements.

According to the present invention, there is provided a laminated evaporator comprising: a plurality of heat exchanging elements, each heat exchanging element being composed of two formed plates each having at least adjacent to its one longitudinal end a pair of laterally projecting tubular portions, one of the tubular portions having an outside diameter substantially equal to the inside diameter of the other tubular portion, each of the formed plates further having a substantially U-shaped groove connected at its opposite ends to the tubular portions, and a plurality of spacers projecting from an outer peripheral edge portion of the formed plate in the same direction as the tubular portions, the spacers having bonding surfaces joined with the bonding surfaces of the spacers of an adjacent one of the heat exchanging elements; a plurality of corrugated fins each disposed between two adjacent ones of the heat exchanging elements; and the heat exchanging elements and the corrugated fins being laminated alternately.

With this construction, tanks of two adjacent heat exchanging elements are connected together by two confronting pairs of the tubular portions that are merely fitted with each other. The spacers of the adjacent heat exchanging elements abut together at a predetermined position so that the spacing between the adjacent heat exchanging elements can be maintained uniformly.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention will be described hereinbelow in greater detail with reference to a preferred embodiment shown in the accompanying drawings.

Figure 1:
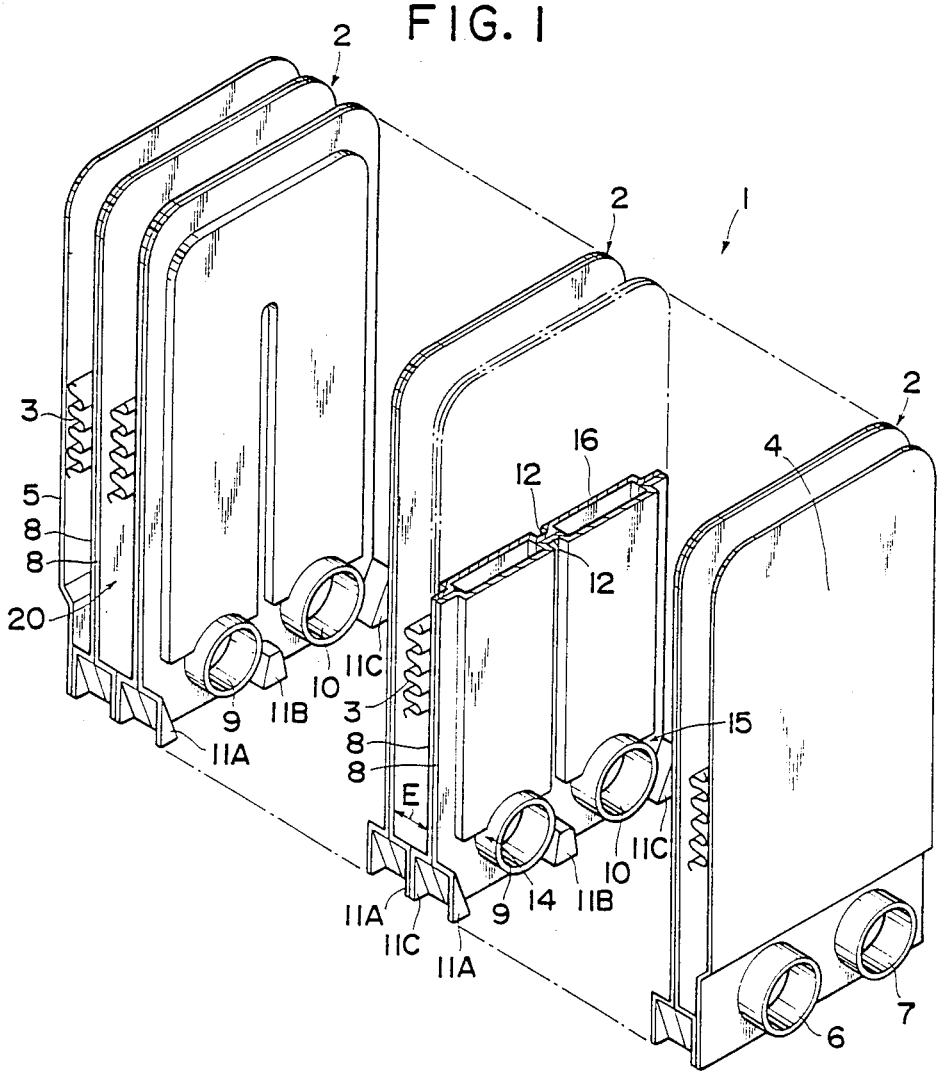
FIG. 1 is a schematic perspective view, partly in cross-section, of a laminated evaporator according to the present invention.
Figure 2:
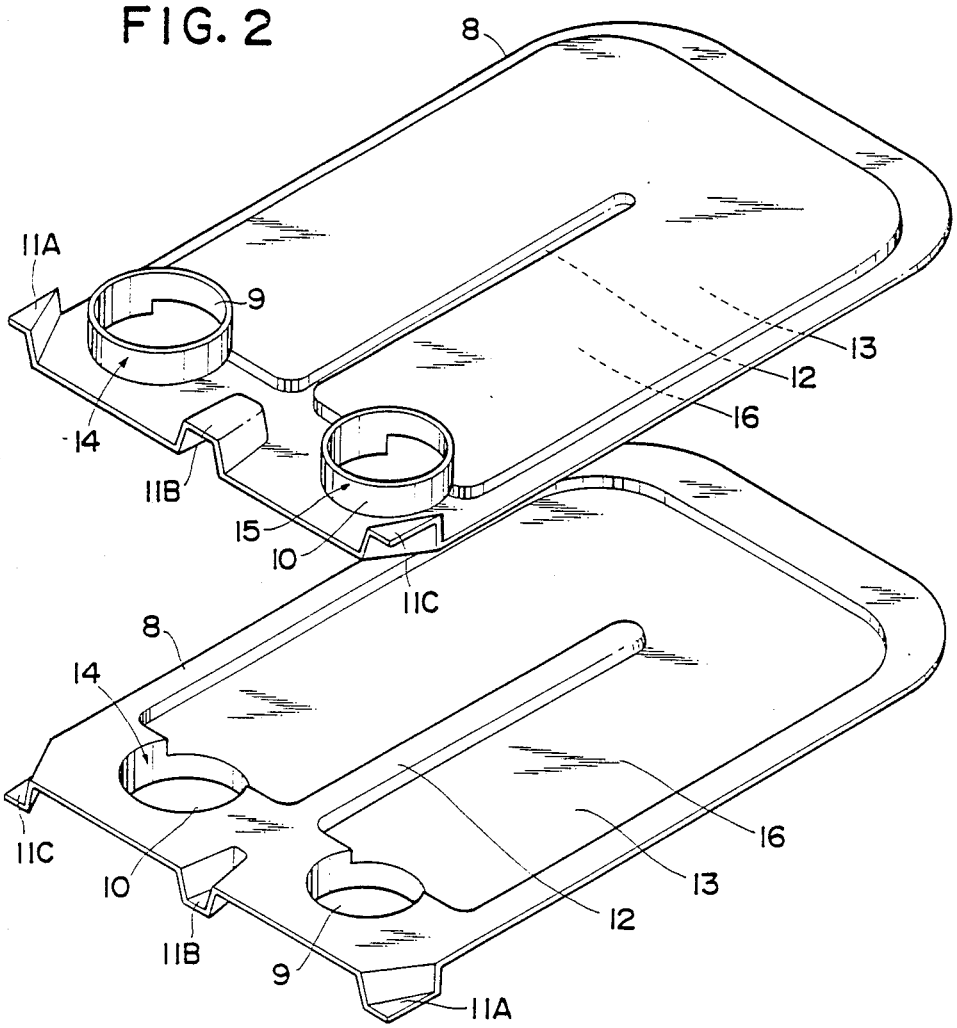
FIG. 2 is a perspective view of a pair of formed plates constituting a single heat exchanging element of the laminated evaporator.
Figure 3:
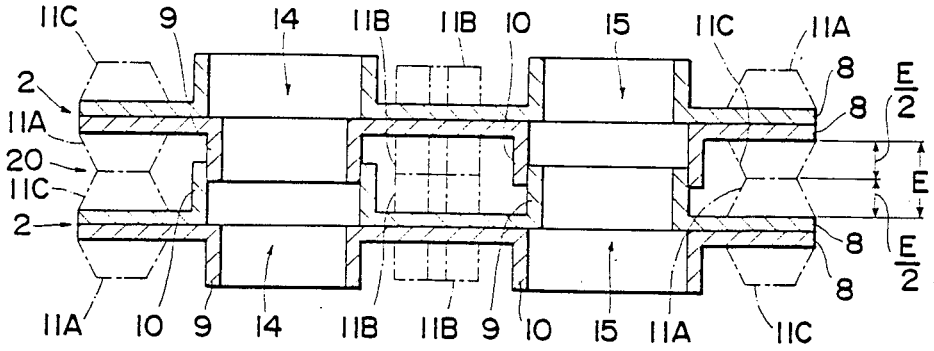
FIG. 3 is an enlarged cross-sectional view of a portion of the laminated evaporator shown in FIG. 1.

As shown in FIGS. 1 through 3, a laminated evaporator according to the present invention generally comprises a plurality of alternately disposed or laminated heat exchanging elements 2 and corrugated fins 3, and two end plates 4, 5 disposed on opposite ends of the thus laminated heat exchanging elements and fins 2 and 3. The end plate 4 is provided at its lower end with an inlet pipe 6 for feeding a refrigerant into the laminated evaporator 1 and an outlet pipe 7 for discharging the refrigerant from the laminated evaporator 1.

Each of the heat exchanging elements 2, as best shown in FIG. 2, is composed of two formed plates 8 joined together in face to face confrontation.

Each of the formed plates 8 has a generally rectangular shape and is formed by press working or stamping from a sheet metal. The rectangular formed plate 8 has at its one longitudinal end two laterally spaced passages or holes 9, 10 and three spacers 11A, 11B, 11C disposed side by side with one hole between two adjacent ones of the spacers 11A–11C, the spacers 11A–11C projecting laterally outwardly from a peripheral edge of the formed plate 8. The formed plate 8 further has a longitudinal ridge 12 extending from a portion adjacent to the spacer 11B toward the opposite end of the formed plate 8, there being defined in the formed plate 8 a substantially U-shaped groove 13 extending along the periphery of the longitudinal ridge 12.

The holes 9, 10 are defined by two elliptical tubular portions which are symmetrical in shape with each other and project laterally outwardly from the formed plate 8. One of the tubular portions has an inside perimeter substantially equal to the outside perimeter of the other elliptical tubular portion. In the illustrated embodiment, the tubular portion 10 has an inside diameter slightly larger than the outside diameter of the tubular portion 9, as shown in FIG. 3. Consequently, when two adjacent ones of the heat exchanging elements 2 are assembled together as described later, the tubular portions 9, 10 of one heat exchanging element 2 are fitted respectively with the tubular portions 10, 9 of the other heat exchanging element 2. Inner ends of the respective tubular portions 9, 10 are communicated with each other via the U-shaped groove 13.

The spacers 11A, 11B, 11C have respective flat portions extending parallel to the general plane of the formed plate 8 and lying in a same plane so that all the spacers 11A, 11B, 11C have a same height. The height of the spacers 11A, 11B, 11C is half of the width E of a space 20 defined between each pair of the adjacent heat exchanging elements 2 for placement of one of the corrugated fins 3, as shown in FIG. 3.

When the heat exchanging elements 2 are assembled together by mutually fitting confronting pairs of the tubular portions 9, 10 as shown in FIG. 3, the spacers 11A–11C of one heat exchanging element 2 engage the spacers 11A–11C of an adjacent one of the heat exchanging element 2 at a position in which the width of the space 20 between the adjacent heat exchanging elements 2 is in equal to the predetermined value E.

The spacers 11A–11C have a mechanical strength which is large enough to withstand forces or pressures tending to bend or yield the spacers 11A–11C when confronting ones of the spacers 11A–11C abut together.

The two formed plates 8 are joined together in face to face confrontation, thereby forming one heat exchanging element 2. The thus formed heat exchanging element 2 has defined therein a pair laterally spaced tanks 14, 15 each composed of two confronting tubular portions 9, 10 or 10, 9, and a U-shaped channel 16 formed jointly by the U-shaped grooves 13 in the respective formed plates 8. The tanks 14, 15 are held in fluid communication with each other via the U-shaped channel 16. Each heat exchanging element 2 is laminated with an adjacent heat exchanging element 2 by interconnecting the confronting tanks 14, 15, that is, by mutually fitting confronting pairs of the tubular portions 9, 10 and 10, 9 until the confronting spacers 11A–11C are brought into abutment with each other. The thus assembled two adjacent heat exchanging elements 2 define therebetween a space 20 of the predetermined width E for the insertion therein of one corrugated fin 3. The corrugated fin 3 is also disposed between the endmost heat exchanging element 2 and each of the end plates 4, 5. The inlet pipe 6 and the outlet pipe 7 are connected with the tanks 14, 15, respectively, of the endmost heat exchanging element 2 (at the right end in FIG. 1).

The laminated evaporator 1 of the foregoing construction operates as follows. A refrigerant is supplied from the inlet pipe 6 into the tanks 14 of the respective heat exchanging elements 2 from which the refrigerant flows through the U-shaped channels 16 into the tanks 15 of the respective heat exchanging elements 2. The refrigerant as it moves along the U-shaped channels 16 is subjected to heat exchanging process with respect to air flowing through the spaces 20 between the adjacent heat exchanging elements 2. Thereafter, the refrigerant is discharged from the outlet pipe 7.

In the interior of each tank 14, 15, the tubular portion 10 has a maximum width in the direction of flow of the refrigerant, as shown in FIG. 3. The tubular portion 9 projects inwardly into the flow passage of the refrigerant and hence narrows the refrigerant flow passage to such an extent equal to twice as large as the thickness of the tubular portion 9. The flow resistance of the tank 14, 15 increases correspondingly but this increase in flow resistance is considerably smaller than the flow resistance which is produced by each tank of the conventional laminated evaporator.

Since the tanks 14, 15 are tubular in shape, the refrigerant flow passages defined therein each have an effective cross-sectional area which is substantially equal to the area of a circle having a diameter equal to the inside diameter of the tank 14, 15. This means that the effective cross-sectional area of the refrigerant flow passage is substantially equal of the size of the tank 14, 15 and the necessary space for the heat exchanging process is no longer occupied largely by the tanks 14, 15. This is a clear contrast to the conventional laminated evaporator in which the tanks are considerably larger in size than the effective cross-sectional area of the refrigerant flow passage.

Figure 4:
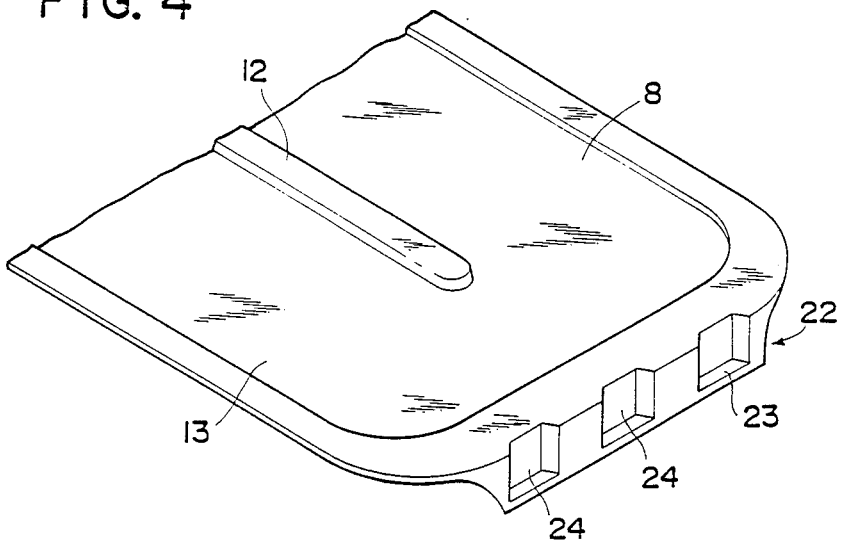
FIG. 4 is a fragmentary perspective view of a formed plate according to another embodiment of the present invention.
Figure 5:
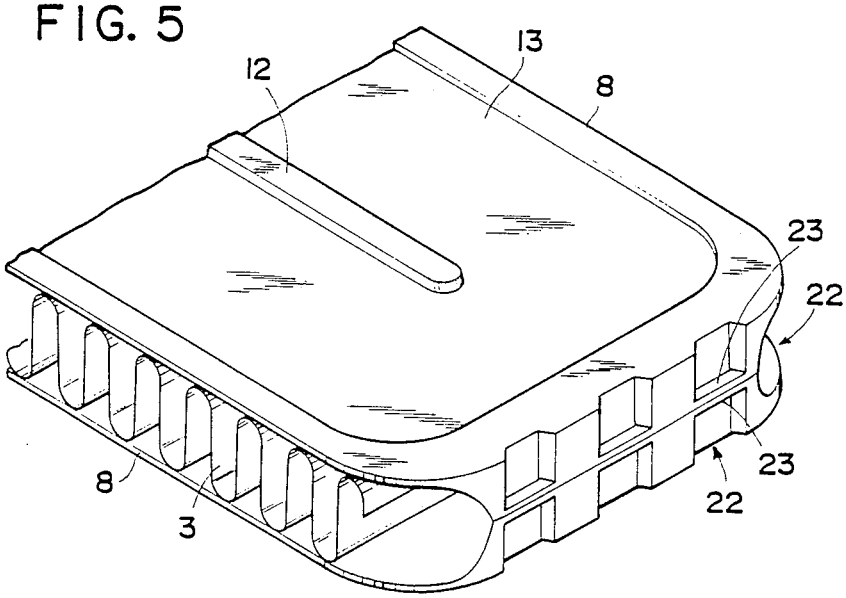
FIG. 5 is a view similar to FIG. 4, but showing two formed plates joined together with a corrugated fin disposed therebetween.

FIGS. 4 and 5 show a modified form of the formed plate 8 according to a second embodiment of the present invention. The modified formed plate 8 includes a retainer wing 22 formed integrally with and projecting laterally outwardly from one end (opposite to the end at which tubular, not shown but identical to the tubular portions 6, 7 shown in FIG. 1, are formed) of the body of the formed plate 8 for keeping the spacing between two adjacent formed plates 8, 8. The retainer wing 22 is bent perpendicularly to the body of the formed plate 8 and has its front end a flat abutment surface 23. The retainer wing 22 has a plurality of laterally spaced reinforcement recesses 24.

Two of the formed plate 8 are joined together to form one heat exchanging element. When two such heat exchanger elements are assembled together, their opposite ends adjacent to tanks formed by the tubular portions are connected together in the same manner as done in the foregoing embodiment. At one ends of the heat exchanger elements, the abutment surfaces 23 of the respective retainer wings 22 are held in abutment with each other to thereby retain the spacing between the two heat exchanging elements, as shown in FIG. 5. The thus obtained inter-element space-holding effect adds to the space-holding effect attained by the spacers 11A–11C of the heat exchanging element 2 of the foregoing embodiment.

In the foregoing embodiments, a pair of tanks is provided at one end of each heat exchanging element. The present invention is not limited to the illustrated embodiment and rather it may be effectively operable when the tanks are provided at opposite ends of each heat exchanging element or when plural tanks are provided at least at one end of each heat exchanging element. In each instance, the tanks are of a tubular shape and confronting ones of the tubular tanks are abutted together, with spacers disposed properly with respect to the tanks, when two adjacent heat exchanging elements are united together. The position, shape and number of the spacers are determined properly.

Obviously, various modifications and variations of the present invention are possible in the light of the above teaching. It is therefore to be understood that within the scope of the appended claims the present invention may be practiced otherwise than as specifically described.

What is claimed is:

1. A laminated evaporator comprising:

(a) a plurality of heat exchanging elements, each heat exchanging element being composed of two formed plates each having at least adjacent to its one longitudinal end a pair of laterally projecting tubular portions, one of said tubular portions having an outside diameter substantially equal to the inside diameter of the other tubular portion, each said formed plate further having a substantially U-shaped groove connected at its opposite ends to said tubular portions, and a plurality of spacers projecting from an outer peripheral edge portion of said formed plate in the same direction as said tubular portions, said spacers having bonding surfaces joined with said bonding surfaces of the spacers of an adjacent one of the heat exchanging elements;

(b) a plurality of corrugated fins each disposed between two adjacent ones of said heat exchanging elements; and (c) said heat exchanging elements and said corrugated fins being laminated alternately.

2. A laminated evaporator according to claim 1, wherein each said formed plate has a retainer wing formed integrally with and extending laterally outwardly from the opposite end of said formed plate, said retainer wing having at its front end a flat abutment surface.

* * * * *